US005096225A

United States Patent [19]

Osawa

[11] Patent Number: 5,096,225

[45] Date of Patent: Mar. 17, 1992

[54] GRASS SKI ROLLER BOARDS

[76] Inventor: Kazuo Osawa, No. 3-4, 3-chome, Miyamachi, Fuchu-shi, Tokyo, Japan, 183

[21] Appl. No.: 499,685

[22] Filed: Mar. 27, 1990

[30] Foreign Application Priority Data

| | | | |
|---|---|---|---|
| Mar. 28, 1989 | [JP] | Japan | 1-77323 |
| Mar. 28, 1989 | [JP] | Japan | 1-77324 |
| Apr. 28, 1989 | [JP] | Japan | 1-50697 |
| May 25, 1989 | [JP] | Japan | 1-61635 |

[51] Int. Cl.[5] ..... A63C 5/06; A63C 17/02

[52] U.S. Cl. ..... 280/842; 280/11.28; 280/87.042

[58] Field of Search ..... 280/842, 11.28, 7.12, 280/7.13, 7.14, 87.041, 87.042, 600, 609, 11.19; 272/97

[56] References Cited

U.S. PATENT DOCUMENTS

| | | | |
|---|---|---|---|
| 3,389,922 | 6/1968 | Eastin | 280/842 |
| 3,403,919 | 10/1968 | Weibling | 280/842 X |
| 3,722,900 | 3/1973 | Dickert | 280/842 X |
| 3,926,449 | 12/1975 | Wilje | 280/842 |
| 3,954,279 | 5/1976 | Guerr | 280/87.042 |
| 4,134,600 | 1/1979 | McDonald et al. | 280/842 X |
| 4,152,001 | 5/1979 | Christianson | 280/87.042 X |
| 4,700,958 | 10/1987 | Volpato | 280/842 |
| 4,708,352 | 11/1987 | Vullierme | 280/11.28 X |
| 4,886,298 | 12/1989 | Shols | 280/842 |
| 4,892,332 | 1/1990 | Jennings | 280/842 |
| 4,961,592 | 10/1990 | Diard et al. | 280/609 |

FOREIGN PATENT DOCUMENTS

| | | | |
|---|---|---|---|
| 2150912 | 4/1973 | Fed. Rep. of Germany | 280/842 |
| 1136599 | 5/1957 | France | 280/842 |

OTHER PUBLICATIONS

"Skate Boarder" Magazine, Jun. 1978 issue, Ventrac Advertisement.

"Skate Boarder" Magazine, Jan. 1979 issue, Kryptonics Advertisement.

*Primary Examiner*—Andres Kashnikow

*Assistant Examiner*—Brian L. Johnson

*Attorney, Agent, or Firm*—Fleit, Jacobson, Cohn, Price, Holman & Stern

[57] ABSTRACT

A grass ski is designed to simulate a snow ski in skiing characteristics. The grass ski has an elongate foot board with forward, central and rear portions. The central portion is arched lengthwise in elevation. Suspended beneath the foot board are spaced pairs of rollers including at least one roller pair on the forward portion, at least three roller pairs on the central portion and at least one roller pair on the rear portion. Each roller has a profile which reduces in diameter towards the outside. Preferably, the left and right hand rollers in plain view are located on concave lines lengthwise of the footboard.

2 Claims, 5 Drawing Sheets

GRASS SKI ROLLER BOARDS

BACKGROUND OF THE INVENTION (1) Field of the Invention

The present invention relates to an improvement of the Grass Ski Roller Board used on areas without snow such as lawns and refers to a Grass Ski Roller Board with motion characteristics, including rolling, rotation, steering (direction change), and braking capabilities similar to ski boards used on snow.

(2) Description of the Prior Art

Grass ski boards have been used on snow-free terrain in the past and have invariably had a roller skate design a little longer than ordinary roller skates, with a multiplicity of rollers centrally arranged on the underside of the rigid ski board provided with fastening facilities for foot attachment so that the grass ski boards known so far were completely different from snow skiing boards in terms of their motion functions, including their rolling, rotating, and braking capabilities.

The present state of the art had therefore discarded all hopes for a grass ski roller board suitable for snow ski training in locations without snow such as artificial lawns and concrete-surfaced areas or for achieving ski competitions on snow-free terrain providing the same feeling of motion as that associated with snow skiing.

SUMMARY OF THE INVENTION

The purpose of the present invention is to resolve the problem areas so far encountered with grass ski boards by providing a grass ski roller board imparting the same feeling of motion on snow-free terrain such as natural or artificial lawns and concrete-surfaced areas as that obtained with actual snow skiing.

A further purpose of the present invention is to provide a grass ski roller board achieving on snow-free terrain the same motion characteristics as those obtained with real snow skiing, in terms of rolling, turning, braking and ski jumping.

To achieve these objectives, the grass ski roller boards according to the present invention are characterized in that whereas said grass ski roller boards are shaped either in the form of a board in such a manner as to have roughly the same length and the same outer shape as snow ski boards with an arched curvature when seen in the side view, and with the center width smaller than at the front and rear, or in the form of a beam having a length and profile roughly identical with the aforesaid snow ski boards, forming a pair of flexible roller bodies with a flexural and torsional elasticity roughly identical with the flexural and torsional elasticity of aforesaid snow ski boards, said grass ski roller boards have a multiplicity of pairs of rollers positioned in the longitudinal directions of the aforesaid elastic roller body so that their rolling surfaces are at a lower location than the bottom of the aforesaid elastic roller body.

BRIEF DESCRIPTION OF THE DRAWINGS

FIG. 1 (*a*) is a top-view drawing, FIG. 1 (*b*) a side-view drawing, FIG. 1 (*c*) bottom-view drawing, and FIG. 1 (*d*) a cross-section drawing along line A—A of FIG. 1 (*b*), representing views of said grass ski roller boards with the rollers attached thereto.

FIG. 2 (*a*) is a top-view drawing, FIG. 2 (*b*) a side-view drawing, FIG. 2 (*c*) bottom-view drawing, and FIG. 2 (*d*) a cross-section drawing along line B—B of FIG. 2 (*b*), representing views of said grass ski roller boards with the rollers attached thereto.

FIG. 3 (*a*) is a top-view drawing, FIG. 3 (*b*) a side-view drawing, FIG. 3 (*c*) bottom-view drawing, and FIG. 3 (*d*) a cross-section drawing along line C—C, representing views of said grass ski roller boards with the rollers attached thereto.

FIG. 4 (*a*) is a top-view drawing, FIG. 4 (*b*) a side-view drawing, FIG. 4 (*c*) bottom-view drawing, and FIG. 4 (*d*) a cross-section drawing along line E—E, representing views of said grass ski roller boards with the rollers attached thereto.

DETAILED DESCRIPTION OF THE PREFERRED EMBODIMENTS

Figure 1A:
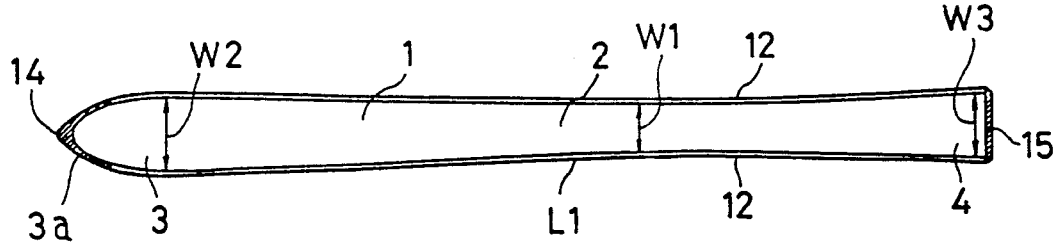
FIGS. 1 (*a*) through 1 (*d*) show the structure of a first embodiment of this invention.
Figure 1B:
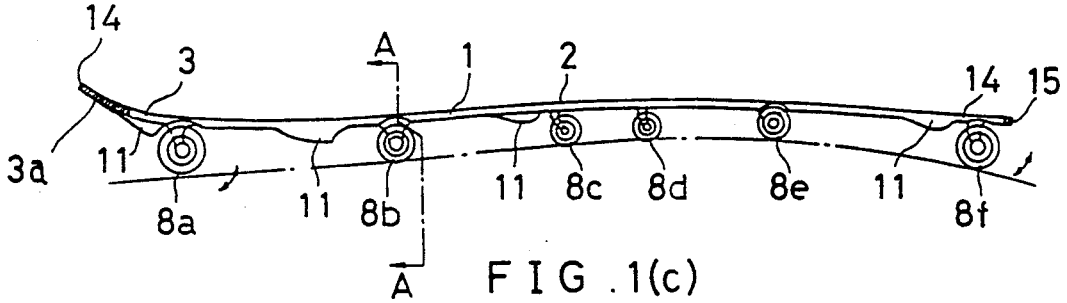
Figure 1C:
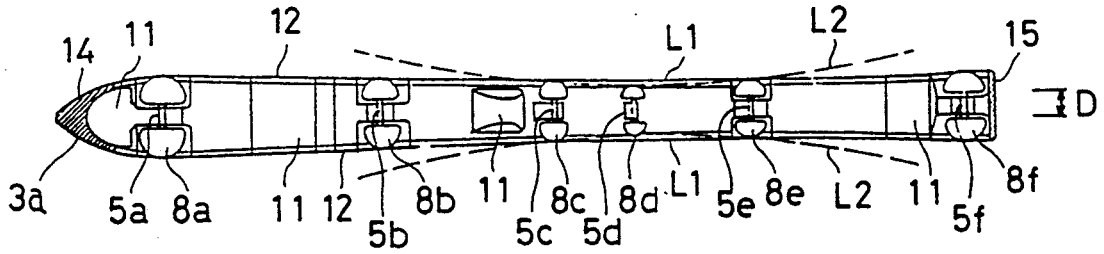
Figure 1D:
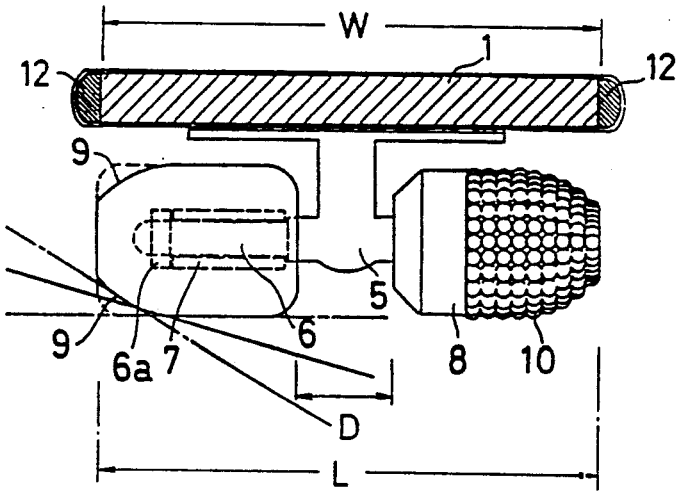
Figure 2A:
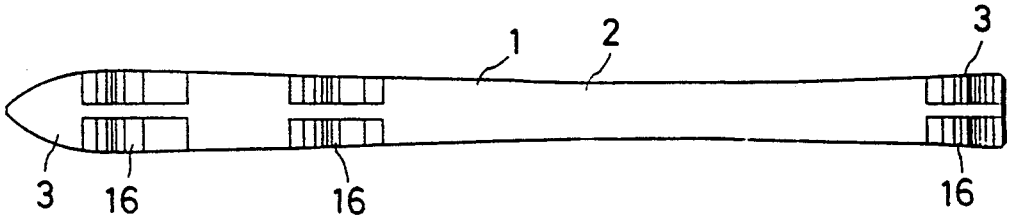
FIGS. 2 (*a*) through 2 (*d*) show the structure of a second embodiment of this invention.
Figure 2B:
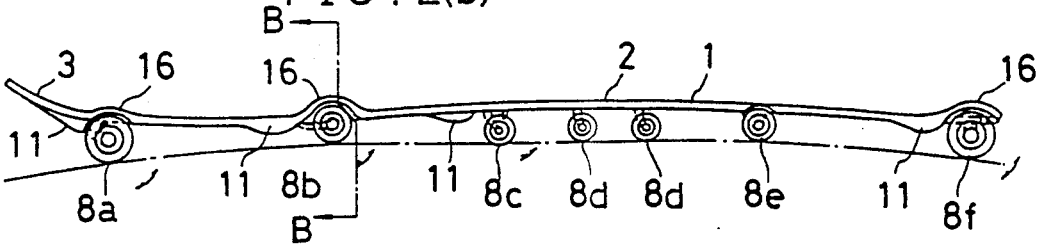
Figure 2C:
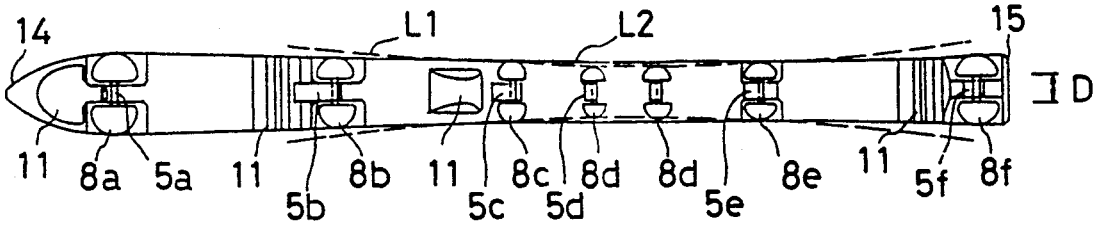
Figure 2D:
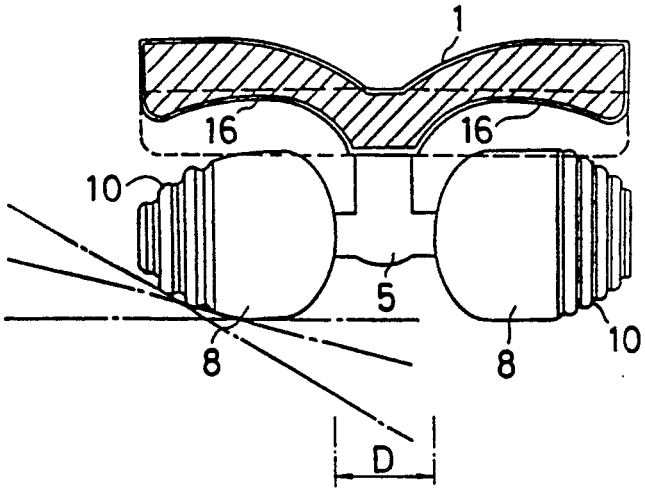
Figure 3A:
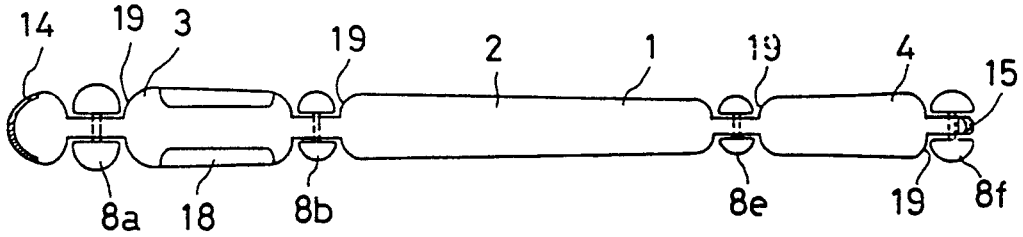
FIGS. 3 (*a*) through 3 (*d*) show the structure of a third embodiment of this invention.
Figure 3B:
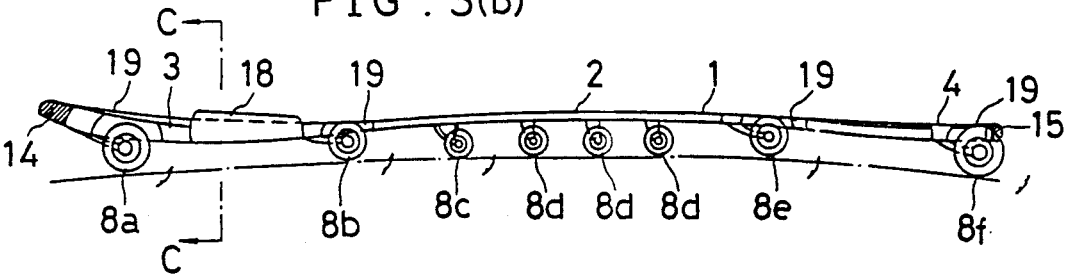
Figure 3C:
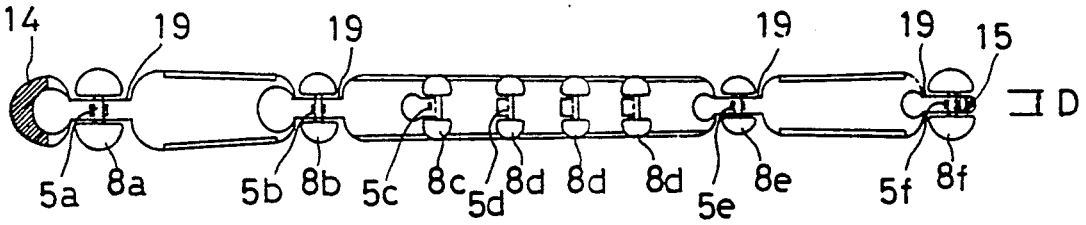
Figure 3D:
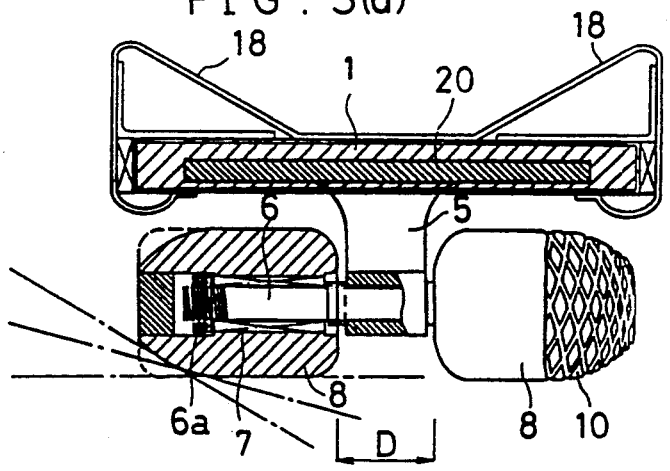
Figure 4A:
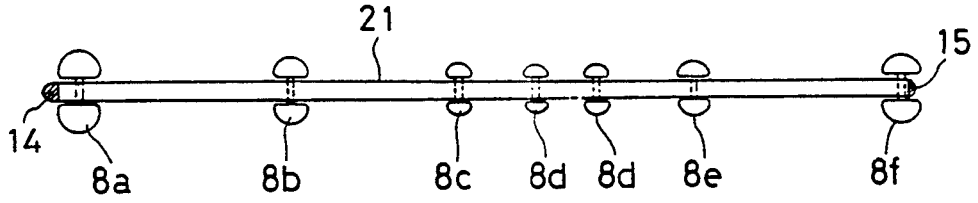
FIGS. 4 (*a*) through 4 (*d*) show the structure of a fourth embodiment of this invention.
Figure 4B:
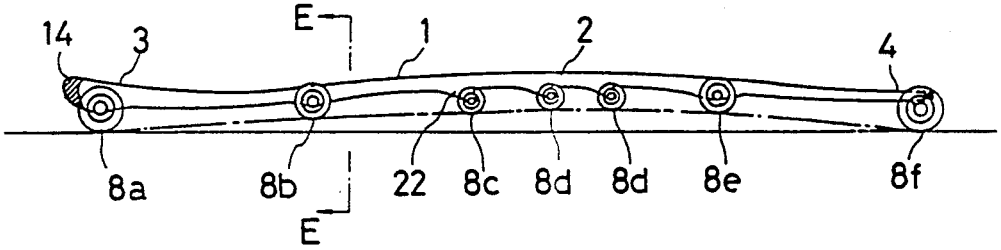
Figure 4C:
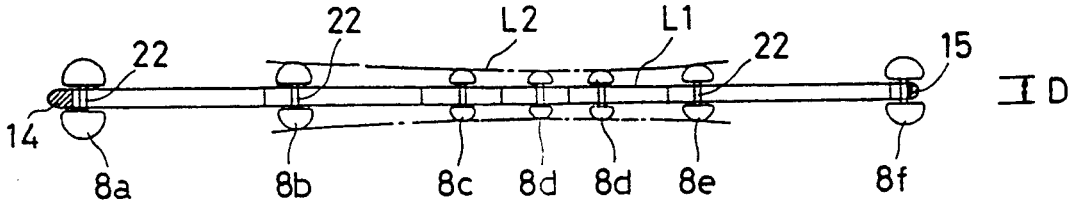
Figure 4D:
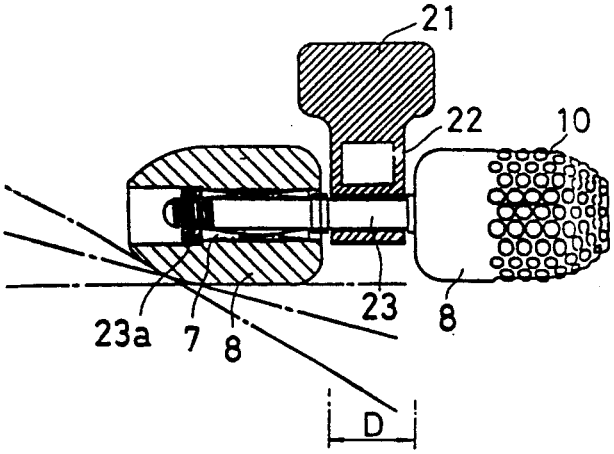

The embodiments of the grass ski roller boards of the present invention are explained with reference to the figures relating thereto. Identical parts are shown in the figures showing the different embodiments by using identical symbols.

Embodiment 1

As shown in figures (*a*) through (*c*), the board for the grass ski according to this embodiment of the present invention is shaped so that the width W1 of the center section 2 is narrower than widths W2 and W3 of the front end 3 and rear end 4, forming a side rim line L1 with a slightly narrowed center in roughly the same shape as in the case of ordinary snow ski board and a pointed spindle-shaped end 3*a*, while, at the same time, said center section 2 has a slightly convex curvature similar to snow ski boards, with the side faces shaped so that the front end 3 is bent upwards, and with the grass ski roller board consisting of a wooden, metallic, or resin material or a composite thereof so as to achieve a flexural and torsional elasticity similar to that of snow ski boards.

The lateral part around the board 1 is fitted with an edge guard 12 protecting the board 1, with the front end edge guard 14 and the rear end edge guard 15 having a greater width for a tougher construction than the side edge guards 12 so as to protect the board 1 against obstacles from the front. Since, however, said edge guards 12, 14, and 15 do not make contact with the ground, it is not necessary to make these edges as rigid as those used on snow ski boards.

Furthermore, the present invention provides for the possibility of freely altering the cross-sectional shape of said edge guides 12, 14, and 15 to any other shape or change the material to any other material, to suit the use of the grass ski roller board or by allowing for design or stylistic effects.

As shown in FIG. 1 (*d*), the underside of ski board 1 is provided with a plurality of metal bearing details 5 in the shape of an inverted T arranged longitudinally along the board 1, with the roller shafts 6 overhanging the metal bearing details 5 on both sides and with each pair of rollers 8, formed by fastening with nuts 6*a* the ends thereof through the roller bearing 7, arranged in such a manner as to permit completely free movement on each roller shaft 6.

Each roller is shaped in the form of a spindle having a curved edge 9 so that the diameter of the outer side is smaller than the diameter of the inner side, while rollers 8*c*, 8*d*, and 8*e* located in the center of the board 1 are disposed in a curvilinear arrangement so that they have a smaller diameter arc than the arc-shaped side line L1 of board 1, as compared with the outer arrangement line L2.

Furthermore, it is desirable that the outer width L formed by each roller pair should be shaped in roughly the same manner as the board width W in the respective mounting location; and as the roller position varies from the center 2 to the front end 3 or rear end 4 so the board width increases and therewith also increases the outer roller width L.

As a result, the stability of the board 1 is improved due to the large width of rollers 8*a* and, 8*b* in the vicinity of front end 3 and the large width of roller 8*f* in the proximity of rear end 4, while flexural and torsional elasticity of the board 1 is achieved with rollers 8*c*, 8*d*, and 8*e* arranged at narrowing widths in passing toward the center 2 and an edging effect is provided by the curved outer edge of the rollers to permit convenient and easy tilting of board 1 with the same motion characteristics as those associated with snow ski boards.

The gap D at which the rollers of the roller pairs are spaced is independent of their relative position in the longitudinal direction and constitutes a uniform width so that a uniform resistance acts on all rollers from the front to the rear.

Moreover, the spacing of the rollers 8*a*–8*f* from the frontmost to the rearmost rollers is arranged so that this spacing is roughly proportional to the load distribution acting on the board 1 during rolling, with the rollers arranged in such a manner that there is a larger number of rollers mounted in the center section than there is at the front and rear parts 3 and 4.

These rollers 8 consist of a synthetic resin such as a hard plastic, while the contact faces of the rollers 8 with the ground and at least their outer periphery, including the curved edge 9, have an irregular surface or tread 10 so that effective friction with the ground-contacting surface is achieved during rolling and motion. Apart from the irregular protrusions shown in embodiment 1, said tread surface 10 may, depending on the shape of the ground-contact surface, have different irregular patterns such as radial stripes and thrust stripes as shown in the embodiments below so as to improve the friction effect in terms of preventing side slip, for example, and by varying the construction material of the rollers it is possible to achieve diversification to suit the condition of the ground-contacting surface.

Mounted to the underside of board 1 are triangular-section roller guard plates 11 made of a suitable metallic or synthetic resin material in front of roller 8*a* or between the rollers in the main parts, for example, between roller 8*a* and 8*b*, rollers 8*b* and 8*c*, and roller 8*e* and 8*f*, with the ground-contacting faces of the rollers mounted in a prominent arrangement but without intrusion so that obstacles can be negotiated during rolling and all rollers can be guarded.

The grass ski roller boards designed in this manner are used in pairs and the upper surface of said board 1 has the same metal fittings for the locating of ski boots as those found on snow ski boards to permit the wearing of boots.

With the above construction, the roller pairs 8,8 are arranged so that they are roughly proportional with respect to the load distribution applied during motion, and, as a result, roughly the same uniform load is applied to all rollers; and, since the grass ski roller boards have roughly the same flexural and torsional characteristics as snow ski boards, the rollers arranged on the board 1 are subject to the same ground-contact pressure as snow ski boards, with respect to each moving surface.

Each roller has a curved edge 9 in the form of a spindle tapered towards the outside, and since the rollers 8*c*, 8*d*, and 8*e* arranged near the center of the board 1 are arranged so that the outer contour line L2 is curved to the inside, it follows that when the board 1 is tilted to the side during rolling, the flexural and torsional elasticity of the board 1 will be effective and tilt easily without any significant resistance and, moreover, as the board tilts the flexural and torsional elasticity will be effective in accordance with the ground-contacting surface of the rollers so as to push the curved edges 9 of the rollers properly against the ground-contacting surfaces to achieve the edging effect in order to obtain motion characteristics similar to those associated with snow ski boards.

The grass ski roller boards according to this invention are therefore usable on snow-free terrain such as natural and artificial lawns as well as concrete-surfaced ground. Similar to snow ski boards, the grass ski roller boards allow jumping in addition to rolling and turning.

Embodiment 2

The grass ski board 1 according to this embodiment has roughly the same construction as that of embodiment 1, with the same action being obtained for each structural part. However, the aspects in which this embodiment differs substantially from embodiment 1 are that rollers 8*a*, 8*b*, and 8*f* near the front-center, front, and rear parts of board 1 have a larger diameter than the diameters of rollers 8*c*, 8*d*, and 8*e* near the center and that the difference in the rotating surfaces with the corresponding larger diameters is kept level with a construction accommodating the roller housing 16 protruding into board 1.

As a result, the rotating capability of the rollers is the more favorable the greater their outer diameter is. In terms of the mobility, the board 1 has different motion characteristics from those of a snow ski board. With the use of a construction, however, in which the large-diameter rollers 8*a*, 8*b*, and 8*f* are accommodated in roller housings 16, the height of board 1 can be made lower, and as a result, the rotating capability of the rollers can be improved without detriment to the stability of the board 1.

As an alternative to the irregular pattern of the treaded surface 10 for rollers 8*a*–8*f*, the figure shows a surface with a radial stripe pattern.

Embodiment 3

The grass ski board 1 according to this embodiment has roughly the same construction as that of embodiment 1, with the same action being obtained for each structural part. However, the aspects in which this embodiment differs substantially from embodiment 1 are that the roller housings 16 for accommodating the rollers 8*a*, 8*b*, and 8*f* in the front and rear parts, made to have a larger diameter to absorb the differences in the rotating surfaces in embodiment 2, have been abolished and have been accommodated in the recesses 19 formed in board 1 instead.

With this construction, it is necessary to use a reinforcement structure with reinforcement plates 20 inserted into plate 1 as shown in FIG. 3 (*d*) so that the rigidity of the remaining parts of board 1 in the section with recesses 19 does not suffer.

Furthermore, in this embodiment, "parabolics" 18, 18 are mounted and fixed on both sides on the upper surface of the front section 3 of board 1. The "parabolics" 18,18 are effective in preventing any entanglement with the board 1 during motion.

Figure 5:
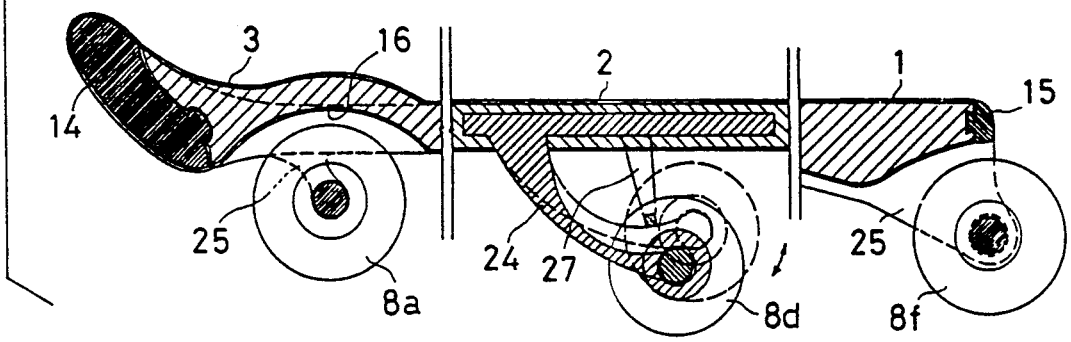
FIGS. 5 (*a*) through (*c*), FIGS. 6 (*a*) through (*c*), and FIGS. 7 (*a*) through (*b*) are partial cross-sectional side views showing the various types of roller arrangement on the grass ski board bodies of embodiments 1 through 3.
Figure 6:
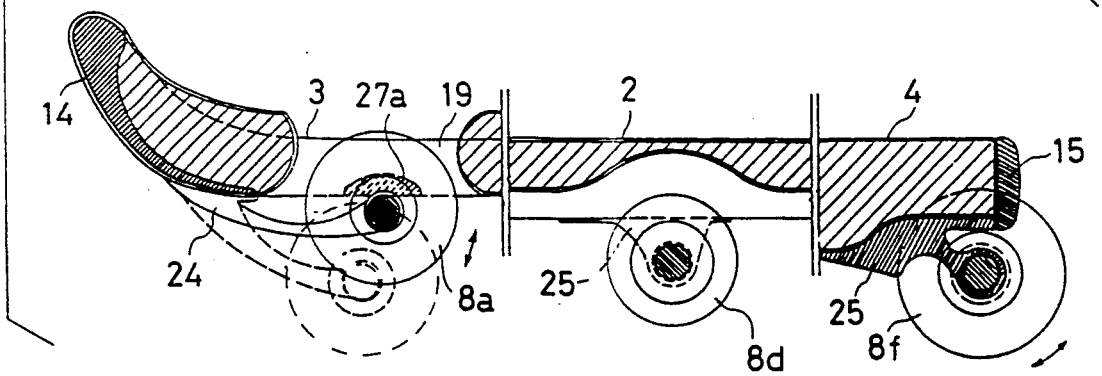
Figure 7:
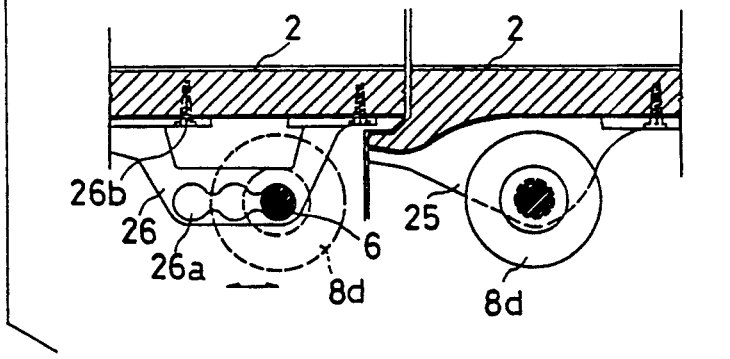

The following explains the various mounting methods for the rollers that can be used for the grass ski roller board according to embodiments 1 through 3 by referring to FIGS. 5 through 7.

The rollers shown in FIG. 5 (*a*) correspond to rollers 8*a* arranged near the front 3, the rollers shown in FIG. 5 (*b*) correspond to rollers 8*d* arranged near the center 2, and the rollers shown in FIG. 5 (*c*) correspond to rollers 8*f* arranged near the rear 4. The same relationship is also shown in FIGS. 6 (*a*) through (*c*). And again, further variants of the rollers mounted in the vicinity of the center 2 are shown in FIGS. 7 (*a*) and (*b*).

Roller 8*a* of FIG. 5 (*a*) are designed so that they are accommodated in the roller housings 16 of embodiment 2, and the metal bearing details 25 in the form of an inverted T, supporting roller 8*a* through roller shaft 6, are identical with the metal bearing details 5 shown in FIG. 2 (*d*).

Roller 8*d* of FIG. 5 (*b*) is designed so that it is supported on the elastic component 24 in the shape of an inverted T, having the required elasticity and capable of elastic deformation in the downward direction as shown by the arrow mark until it strikes against the elastic striker pad 27 projecting from the bottom of board 1 in the bend-limiting position. When the rollers are fixed with the use of said elastic pad 24, it is possible to achieve a cushioning effect when rolling over an obstacle.

While roller 8*a* of FIG. 6 (*a*) uses an elastic pad 24 similar to that of FIG. 5 (*a*), the fixing position thereof is the recess 19 of board 1 of embodiment 3. Thus has a similar cushioning effect when rolling over an obstacle, but in this construction it strikes, in the bend-limiting position, against the elastic striker pad 27*a* buried in bottom of board 1 as the bend-limiting detail.

Rollers 8*d* and 8*f* shown in FIGS. 5 (*c*) and 6 (*b*) have a fixed metal bearing detail 25 lacking the aforedescribed elasticity. These rollers are principally mounted in the center 2 and rear section 4 which do not require such a great cushioning effect, and, as shown in the figure, the bottom of the board 1 has a partially curved shape at the mounting position to house these roller.

Roller 8*f* of FIG. 6 (*c*) has the fixed metal bearing detail 25 shown in FIGS. 5 (*c*) and 6 (*b*) and is thus suitable for the rear 4 which is provided with the same recesses 19 as those of embodiment 3.

FIGS. 7 (*a*) and (*b*) show the metal bearing detail for the roller in the vicinity of the center section 2, and in addition to the fixed metal bearing detail 25 as shown in FIG. 7 (*b*), it is possible to have, as the metal bearing detail in said center 2, a metal bearing detail 26 which accommodates fore-aft adjustment of the front and rear position of roller shaft 6 as shown in FIG. 7 (*a*). Said metal bearing detail 26 is perforated toward the front and rear in the form of bearing through-holes 26*a* in the shape of several lobes, so that it can be fastened to the bottom of board 1 by means of holding screws 26*b* to support the roller 8*d* in the required hole of the bearing holes 26*a*. By this means, it is possible to adjust the position of the center of gravity by altering the locating position for the rollers through changing the selected position of the bearing hole 26*a*.

The above figures have shown various metal bearing details for rollers corresponding to the mounting positions, and it is possible to make suitable use thereof by giving consideration to the motion surface state or the condition of use.

Embodiment 4

In this embodiment, the ski board is not a flat board as used in embodiments 1 through 3 but an elastic roller beam 21 having roughly the same length as that for snow ski boards, and, as shown in FIG. 4 (*b*), the center 2 has a convex curvature similar to a snow ski board, as seen from the side, with the pointed end 14 bent upward and consisting of a board material such as wood, metal or synthetic resin or composites thereof, constructed so that its flexural and torsional elasticity is similar to that of a snow ski board. With this construction, the elastic roller beam 21 in this embodiment can achieve the same motion characteristics as a snow ski board, similarly to embodiment 1.

As shown in FIG. 4 (*d*), rollers 8*a*–8*f* consist of roller pairs 8,8 made from the same material and in the same shape as in embodiment 1 by fastening them with nuts 23*a* through roller bearings 7 so that they can freely move at both extremities of roller shafts 6 supported in bearings 22 projecting downward in a multiplicity of locations from elastic roller beam 21.

Moreover, the gaps D between rollers pairs 8*a*–8*f* are identical regardless of whether they are in the front or rear positions, similarly to embodiment 1, while the positions of the front and rear rollers 8*a*–8*f* are arranged so that they are roughly proportional to the load distribution applicable to said elastic roller beam 21, with a greater number of rollers being mounted in the center 2 than in the front 3 and rear 4 sections. The outer contour line L2 of rollers 8*c* and 8*d*, arranged in the vicinity of the center 2 functioning as the boot-fastening location, has a curved shape to that it forms a smaller-diameter arc than the arc-shaped contour line L1 of the elastic roller beam 21. Furthermore, edge guards 14 and 15 are mounted at the front and rear ends of the elastic roller beam 21 to protect the elastic roller beam 21 from obstacles in the front and rear directions.

Moreover, similarly to embodiments 2 and 3, the rollers 8*a*, 8*b*, 8*e*, and 8*f* in the vicinity of the front and rear ends of the elastic roller beam 21 have a smaller diameter than rollers 8*c* and 8*d* in the vicinity of the center 2.

With the above construction, the elastic roller beam 21 according to this embodiment is capable of achieving the same motion characteristics as those of a snow ski board, similarly to embodiment 1.

In this embodiment, too, a multiplicity of rollers are arranged so that they are proportional to the load distribution applicable during rolling so that all rollers are subject to an even load to achieve the same load distribution characteristics as with snow ski boards. Since the elastic roller beam 21 has the same flexural and torsional characteristics as a snow ski board, the edging effect acting on each roller is similar to the characteristics of a snow ski board.

While there has been described what are at present considered to be preferred embodiments of the invention, it will be understood that various modifications may be made thereto, and it is intended that the appended claims cover all such modifications as fall within the true spirit and scope of the invention.

What is claimed is:

1. A grass ski comprising an elongate footboard having a forward portion, a central portion and a rear portion, the central portion being arched lengthwise in elevational view, and a plurality of roller pairs interconnected with said extending beneath the footboard in spaced relation lengthwise of the footboard including at least one roller pair on the forward portion, at least three roller pairs on the central portion and at least one roller pair on the rear portion, each roller pair on the central portion comprising respective left and right hand rollers, and each roller having a diameter which reduces toward an outer end of the roller wherein the footboard is formed with upwardly extending bulges receiving the rollers on the front and rear portions.

2. A grass ski comprising an elongate footboard having a forward portion, a central portion and a rear portion, the central portion being arched lengthwise in elevational view, and a plurality of roller pairs interconnected with said extending beneath the footboard in spaced relation lengthwise of the footboard including at least one roller pair on the forward portion, at least three roller pairs on the central portion and at least one roller pair on the rear portion, each roller pair on the central portion comprising respective left and right hand rollers, and each roller having a diameter which reduces toward an outer end of the roller wherein the footboard has cut-outs on longitudinal edge portions thereof receiving the rollers on the front and rear portions.

* * * * *